United States Patent [19]

Schmidt

[11] Patent Number: 4,744,146

[45] Date of Patent: May 17, 1988

[54] ADJUSTABLE-BLADE SAFETY KNIFE WITH CARTON-CUTTING GUIDE

[75] Inventor: Gregory G. Schmidt, Newport Beach, Calif.

[73] Assignee: Pacific Handy Cutter, Inc., Costa Mesa, Calif.

[21] Appl. No.: 938,366

[22] Filed: Dec. 4, 1986

Related U.S. Application Data

[63] Continuation-in-part of Ser. No. 830,980, Feb. 19, 1986, abandoned.

[51] Int. Cl.[4] ..... B26B 1/08

[52] U.S. Cl. ..... 30/162; 30/2; 30/286; 30/320; 30/125

[58] Field of Search ..... 30/2, 125, 162, 286, 30/320, 335

[56] References Cited

U.S. PATENT DOCUMENTS

| | | | |
|---|---|---|---|
| D. 248,538 | 7/1978 | Richards . | |
| 2,095,164 | 10/1937 | Babb | 30/2 |
| 2,776,484 | 1/1957 | Resner | 30/125 X |
| 3,195,231 | 7/1965 | Lightburn . | |
| 3,406,447 | 10/1968 | Travlos . | |
| 3,667,122 | 7/1972 | Black . | |
| 4,005,525 | 2/1977 | Gringer | 30/162 X |
| 4,089,112 | 5/1978 | Richards | 30/162 |
| 4,389,776 | 6/1983 | Okada | 30/162 |
| 4,442,595 | 4/1984 | Sharrow et al. | 30/2 |
| 4,509,260 | 4/1985 | Gringer | 30/162 |
| 4,586,256 | 5/1986 | Weimann | 30/162 |

*Primary Examiner*—E. R. Kazenske
*Assistant Examiner*—Michael D. Folkerts
*Attorney, Agent, or Firm*—Poms, Smith, Lande & Rose

[57] ABSTRACT

An improved, adjustable-blade safety knife of the type having a replaceable, single-edge blade slidably-retained within a single-piece handle against a keeper plate having a tang to engage the blade in a side-by-side assembly for protraction and retraction out of one end of the handle has planar guide member extending forward from the cutting end at one side of the knife at a controlled distance from the blade when the blade is extended and at a slight angle relative to the blade such that, when the face of the guide is brought into contact with the surface of a cardboard container, the blade is constrained to cut the side of the carton at a slightly inclined angle from the horizontal and along a line whose spacing from the container top is closely controlled, thereby preventing injury to the container's contents. A U-shaped retainer clip is disclosed which is slidably-retained in the rear of the handle and cooperates with a laterally-extending pin at about the middle of the handle to define a spare-blade-receiving space within the handle within which a plurality of spare blades may be safely stored for future use.

11 Claims, 2 Drawing Sheets

Fig. 1.
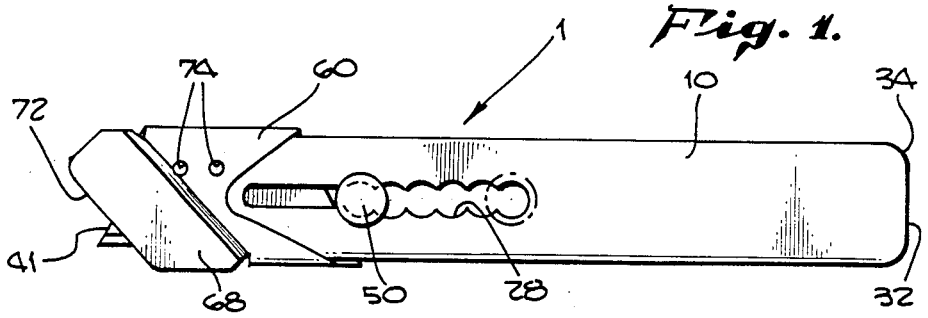
Fig. 2.
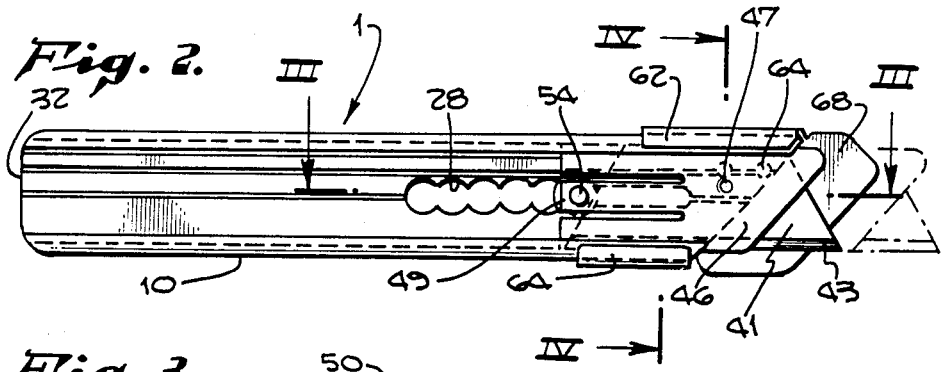
Fig. 3.
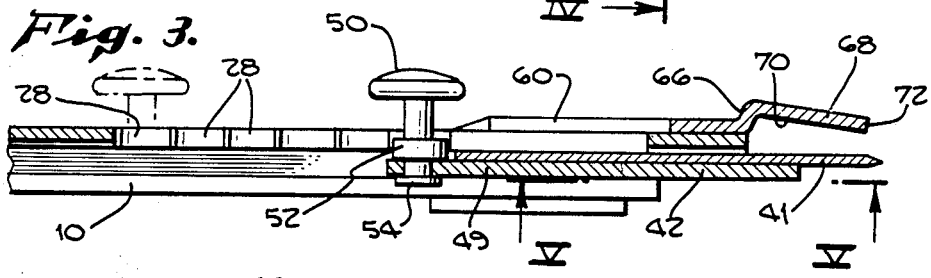
Fig. 5.
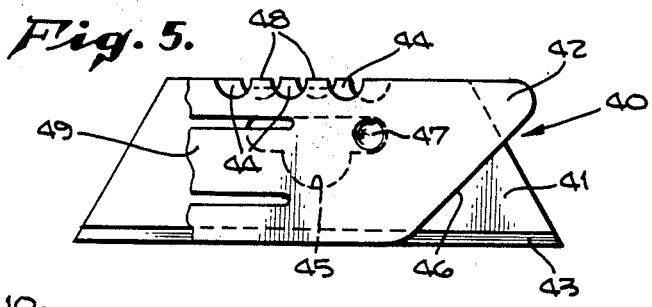
Fig. 4.
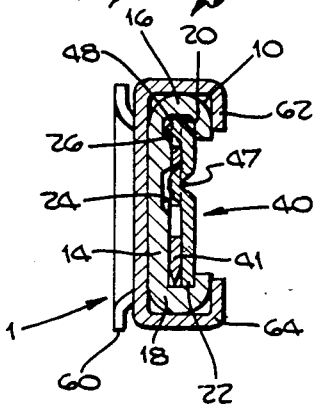
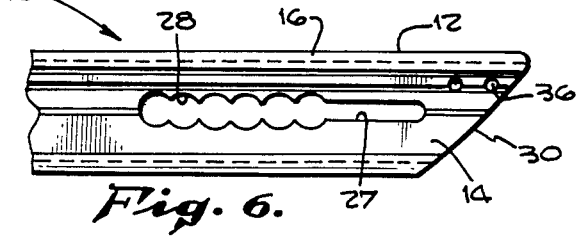
Fig. 6.

ADJUSTABLE-BLADE SAFETY KNIFE WITH CARTON-CUTTING GUIDE

This is a continuation-in-part of co-pending application Ser. No. 830,980, filed on 2/19/86, now abandoned.

BACKGROUND OF THE INVENTION

1. Field Of The Invention

This invention pertains, in general, to hand-held cutting tools, and in particular, to an improved, adjustable-blade safety knife and a carton-cutting guide therefor.

2. Description Of The Related Art

Adjustable-blade knives in which a replaceable, single-edge blade having a very sharp cutting edge is slideably-retained within a handle assembly have found widespread use in a variety of industries, for a variety of tasks, e.g., shipping-and-receiving, wallboard construction, wallpapering, tile-laying etc.

Such a useful tool has previously been disclosed in U.S. Pat. No. 4,089,112 to J. L. Richards, and assigned to the instant assignee. This knife has a one-piece, extruded handle in which a continuous, longitudinally-extending recess forms a web between thicker edge portions, the recess extending laterally into the edge portions to form a pair of continuous, longitudinally-extending top and bottom slots, each slot having a pair of oppositely-faced side walls, one of which side walls is adjacent and co-planar to one side wall of the web, between which side walls are slidably-retained the top and bottom edges, respectively, of a keeper-plate-and-cutting blade assembly, the blade having a central aperture and being constrained to slide within the slots in side-by-side relationship with the keeper plate by the engagement of a laterally-extending tang on the top edge of the plate within one of a plurality of notches in the top edge of the blade, the assembly being adjustably-retractable in and out of the forward end of the handle through a plurality of locked positions by movement of a cammed button member acting in cooperation with a spring arm formed integrally of the keeper plate and a notched slot in the web.

As a consequence of its low cost, light weight and safe reliability, the knife has received considerable commercial acceptance, along with suggestions from customers of areas for improvement of it and other such available knives.

One such area concerns the replaceability of the blade. These blades are so-called "all-purpose" or "AP" blades of the type manufactured by, e.g., Americal Safety Razor Co. or Ardell Industries, Inc., and are retained within the handle of the knife at the bottom by the lower groove and at the top by the upper groove and the engagement of a bent-over finger, or tang, which engages one of a plurality of the notches in the upper edge of the blade provided by the manufacturer. The blade is removed from the knife by extending the keeper plate and blade assembly all the way forward out of the knife, which permits the blade to be swung down at its rear, lower end away from its engagement with the tang in the keeper plate. It has been learned that, in some cases, especially when the keeper plate and blade are extended completely forward with some force, the blade will simply drop from the handle by its own weight, resulting in a dropped and/or possibly lost blade. Thus, it would be desirable if means could be provided for retaining the blade on the keeper when both are fully extended from the knife, so that the blade may be manually removed by the user.

Another such area for improvement relates to the method of indexing the blade to the keeper plate within the knife. As discussed above, the blade is so indexed by means of the engagement of the tang on the top of the keeper plate within one of the plurality of notches on the blades's top edge. The tang cannot be made to extend laterally across the complete width of the blade because, for tolerance reasons, the end of the tang might interfere with the side wall of the upper groove adjacent to the blade, resulting in galling or jamming of the knife. It has been learned that, under certain circumstances in which considerable cutting force is being exerted on the blade by the user, particularly forces having components acting laterally to the blade, the blade and/or keeper can be deformed apart to the extent that the tang becomes disengaged from the blade, resulting in dislodgement of the blade from the handle.

Yet another suggested area for improvement in the knife relates to its use for cutting open cardboard cartons by stocking clerks in grocery stores, and the like. Their duties entail the frequent opening of cardboard shipping containers to remove the products therefrom for shelf stocking which typically involves slicing the top of the carton through the side wall of the container with a sharp knife. If the contents of container are not tamped thoroughly and/or the knife is not applied with a steady hand and a keen eye, the valuable contents of the containers can be sliced through and damaged. Accordingly, they have suggested that it would be desirable to provide some means for guiding the knife while cutting open a container which would prevent injury to the container's contents.

A type of cutting guide is described in U.S. Pat. No. 3,195,231 to H. M. Lightburn for "Razor Blade Holder And Accessory Therefor." Unfortunately for the above, Lightburn's holder and accessory are adapted for generating a pair of display trays for the carton contents from the paper shipping cartons, and not to the protection of the contents of the carton during cutting.

SUMMARY OF THE INVENTION

Still yet another suggested area for improvement in the knife relates to the desirability of being able to store spare blades within the knife itself. For example, Gringer in U.S. Pat. Nos. 4,005,525 and 4,509,260 discloses a blade-receiving space within the rear of the handle of that knife suitable for retaining a plurality of replacement blades for handy use. It would be desirable to provide such a means for blade storage in the instant knife.

An object of the present invention is, therefore, the provision of an improved, adjustable-blade safety knife of the type described in which means are provided to retain the blade in association with the keeper when the keeper-plate-and-blade assembly has been extended to its farthest position of protraction from handle, to prevent the blade from falling out of the handle.

It is another object of the present invention to provide additional means for indexing the blade within the handle to prevent slippage between the keeper plate and blade during heavy cutting, such as would induce forces acting transversely to the blade.

Yet another object of the present invention is the provision of a carton-cutting guide member for use with the knife which contrains the blade to cut at a spaced distance from the top surface of the carton and in which the blade is also constrained to cut at an angle which is slightly inclined to the horizontal plane, to prevent damage to the contents of the carton.

Yet another object of the present invention is the provision of means for conveniently and safely storing a plurality of replacement blades within the handle of the knife.

It is still yet another object of the present invention to provide these improvements in a knife which is inexpensive to manufacture, rugged, reliable, light weight and simple to use.

These and other objects are preferably achieved in a knife of the type described in which at least one indentation in the keeper plate in the side opposite to the blade forms a detent, the detent being located to protrude laterally through the central aperture of the blade immediately below the upper edge of the blade's aperature such that the blade is supported from below by the detent when the keeper plate is fully extended from the handle, the handle having a longitudinally-extending groove in an inside wall of the web, adjacent to the blade, intermediate of the slots and opposed to the indentation to clear the laterally-protruding detent, and at least two tangs formed on the upper edge of the keeper plate for engagement with at least two notches in the upper edge of the blade, the tangs being formed to extend laterally for at least with width of the blade, and wherein the upper slot side wall of the handle adjacent to the blade contains a longitudinally-extending recess below the inside wall of the handle's web to clear the laterally-extending tangs.

Additional objects of the present invention are preferably achieved by the provision of a carton-cutting guide for attachment to the forward end of the handle, the guide including a thin planar member having a short portion flanged laterally outward from one side of the handle at about a right angle along a first line parallel and co-planar to the forward end of the handle, and a longer portion flanged inwardly along a second line substantially parallel to the first line at an angle slightly greater than a right angle such that the plane of the longer portion is inclined slightly toward the plane of the blade, the longer portion having a length equal to the exposed length of the blade when the blade is at a position of extension from the handle, the guide having a forward edge parallel to the forward end of the knife and spaced apart from the blade by at least the thickness of a standard sheet of carton stock.

The blade-storage object is preferably achieved by the provision of a U-shaped retainer clip having top and bottom edges slidably-retained in the handle top and bottom slots, respectively, and a lateral height slightly greater than the width of the slots such that the clip is compressed in a lateral direction and retained in place within the handle when the clip is inserted into the recess from the rear end of the handle, which clip acts in cooperation with a laterally-extending pin pierced and formed into the handle immediately rearward of the rearmost position of the blade and keeper plate to define a spare-blade-receiving space therebetween.

A more complete understanding of the improved knife of the present invention may be obtained from a consideration of the following detailed description of the preferred embodiments, when read in conjunction with the appended drawings, of which the following is a brief description.

BRIEF DESCRIPTION OF THE DRAWINGS

FIG. 1 is a left-hand side view of a knife in accordance with the present invention;

FIG. 2 is a right-hand view of the knife in which sections III—III and IV—IV are taken, and in which the most-extensive position of the keeper and blade are shown in phantom lines;

FIG. 3 is a section through the body of the knife as revealed by the section III—III taken in FIG. 2;

FIG. 4 is a sectional view through the body of the knife as revealed by the section IV—IV taken in FIG. 2;

FIG. 5 is a partial, sectional view through the side of the keeper plate and blade of the knife, as revealed by the section V—V taken in FIG. 3;

FIG. 6 is a right-hand, side view of the extruded handle of the present invention;

DESCRIPTION OF THE PREFERRED EMBODIMENTS

Figure 7:
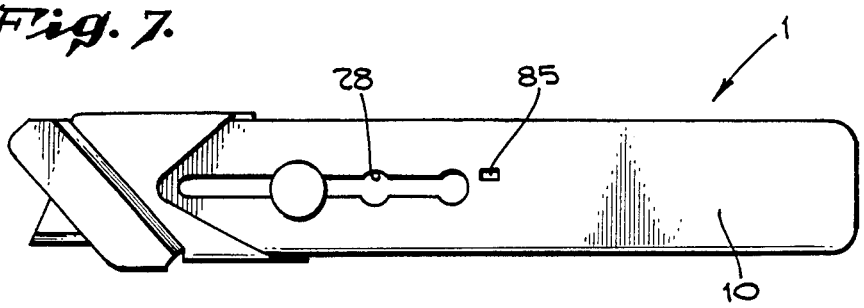
FIG. 7 is a left-hand, side view of an alternative embodiment of a knife in accordance with the present invention.

A preferred embodiment of the subject of the present invention, an improved, adjustable-blade safety knife 1 is illustrated in FIGS. 1 and 2. Knife 1 comprises a one-piece handle 10, a keeper-plate-and-blade assembly 40 and a carton-cutting guide 60.

Handle 10 is preferably formed as an extrusion 12 of a hardenable material, then stamped out as a single part. Extrusion 12 includes a continuous, longitudinally-extending recess forming a web 14 between thicker edge portions 16 and 18, the recess extending laterally into the edge portions to form opposed, longitudinally-extending, top and bottom slots 20 and 22, respectively, each slot having a side wall adjacent and co-planar to the inside wall of web 14. Web 14 additionally includes a continous, longitudinally-extending groove 24 in its inside wall intermediate of slots 20 and 22 and a continous, longitudinally-extending recess 26 below the inside wall of web 14, the purpose of which features is explained below.

In addition to the extruded features, the extrusion 12 of handle 10 is preferably stamped to include positioning features, including an elongated slot 27 through web 14 and a plurality of overlapping, interconnected circular slot portions 28 (see FIG. 6). The cutting, or forward end 30 of handle 10 is stamped at an angle relative to the longitudinal axis of knife 1 to aid in guiding knife 1 during cutting. The rear end 32 of handle 10 is provided with generous corner radiuses 34 for comfort in the hands of the user. A pair of staking holes 36 is provided at forward end 30 of handle 10 for staking of carton-cutting guide 60.

Keeper-plate-and-blade assembly 40 is illustrated in FIG. 5, and includes a blade 41 and keeper blade 42. Keeper-plate-and-blade assembly 40 is slidably-retained at its top and bottom edges between the side walls of top and bottom slots 20 and 22, respectively, of handle 10. Blade 41 includes a razor-sharp cutting edge 43 at its lower edge, a plurality of semi-circular notches 44 in its upper edge, and a hat-shaped, central aperture 45. Keeper plate 42 has a forward edge 46 which is angled to match that of the forward end 30 of handle 10.

In order to overcome one of the problems with prior art knives, keeper plate 42 is preferably punched to include a circular indentation in one side of keeper plate 42 to form a hemispherical detent 47, which is located to protrude laterally through the central aperture 45 of blade 41 immediately below the upper edge of aperture 45 such that blade 41 is supported from below by detent 47. Thus, when keeper-plate-and-blade assembly 40 is extended completely forward in handle 10 such that blade 41 is no longer supported from below by lower slot 22 (such as incident to changing of blade 41), blade 41 will be retained on keeper plate 42 until the user can grasp blade 41 with the fingers and remove it from knife 1 by first deflecting blade 41 laterally past detent 47, then tipping blade 41 downward for removal.

In order to prevent galling or interference between detent 47 and the inside wall of web 14, a continous, longitudinally-extending groove 24 is provided in the inside wall of web 14, adjacent to blade 41, intermediate of slots 20 and 22, and opposed to detent 47 to clear detent 47 during movement of keeper-plate-and-blade assembly 40.

The second problem with prior art knives discussed above, namely, the slippage between blade 41 and keeper 42 during heavy cutting, is preferably solved in the embodiment illustrated in FIG. 5, in which at least two indexing tangs 48 are formed on the upper edge of keeper plate 42 for engagement with at least two of the notches 44 in the upper edge of blade 41, the tangs being bent over to extend laterally for at least the width of blade 41. The provision of two tangs 48 has the effect of rigidizing blade 41 within handle 10 to prevent relative movement between the two during hard cutting, particularly when keeper-and-blade assembly 40 is extended to a more-forward position within handle 10. Additionally, by forming tangs 48 to extend laterally for at least the width of blade 41, movement of blade 41 relative to keeper 42 in a direction normal to their planes during heavy cutting is more easily accommodated without relative slippage. However, as in the case of the provision of support detent 47, tolerance problems entail the provision of a continuous, longitudinally-extending recess in the side wall of upper slot 20 below the inside wall of web 14 to clear tangs 48 during sliding of keeper-and-blade assembly 40.

To accommodate the positioning of keeper-plate-and-blade assembly 40, keeper plate 42 is trifurcated at its rear end to form a central, rearwardly-extending spring member 49 to the end of which is attached a laterally-extending button member 50 having a cammed surface 52 adapted for cooperation with the circular slot portions 28 in handle 10. Button member 50 is manually-operable from the side of handle 10 opposite the circular slots 28 to permit spring arm 49 to be selectively-depressed away from handle 10 and out of engagement with slot portions 28, to adjust the position of the keeper-plate-and-blade assembly 40 relative to handle 10.

In order to overcome one of the problems of prior art knives discussed above, the preferred embodiment of the knife of the present invention provides a carton-cutting guide 60. Guide 60 is preferably fabricated from a single piece of stamped, formed sheet metal having upper and lower channel sections 62 and 64, respectively, disposed to wrap around and grasp upper and lower edge sections 16 and 18, respectively, of handle 10. Guide 60 is staked through holes 36 in handle 10 by a pair of rolled-over stakes 74 to prevent guide 60 from eing dislodged from handle 10.

Guide 60 comprises a thin, planar member having a short portion 66 flanged laterally outward from one side of handle 10 at about a right angle along a first line parallel and co-planar to the forward end 30 of handle 10, and a longer portion 68 flanged inwardly along a second line 70 substantially parallel to the first line at an angle slightly greater than a right angle such that the plane of longer portion 68 is inclined slightly toward the plane of blade 41. The longer portion 68 of guide 60 has a length equal to the exposed length of blade 41 while blade 41 is at an extended position relative to handle 10 and has a forward edge 72 which is spaced apart from blade 41 by the thickness of a standard sheet of carton stock, i.e., about 3/16".

Thus, when carton-cutting guide 60 is brought into contact with the upper surface of a cardboard container, blade 41 is positioned accurately just below the thickness of the lid of the container, and when the inner surface of longer portion 68 is brought into contact with the upper surface of the carton, knife 1, and hence cutting blade 41, are inclined at a slight upward angle relative to the horizontal, which permits the tip of blade 41 to pass accurately over the top of the contents of the container, hence avoiding injury to the contents. The slightly inclined angle of guide 60 prevents blade 40 from being inclined below the horizontal plane, thereby eliminating the potential for nicking of the carton's contents with the tip or edge blade 41.

A means for conveniently and safely storing a plurality of replacement blades within the knife 1 of the present invention is illustrated in FIGS. 7–12. Spare blade storage is facilitated within handle 10 of the present knife by the presence of top and bottom slots 20 and 22, respectively, which extend longitudinally throughout the length of handle 10, and define the upper and lower margins of a blade-receiving space within handle 10 rearward of the rearmost position of keeper-plate-and-blade assembly 40, which is generally indicated by the rearmost of the circular slots 28.

Figure 8:
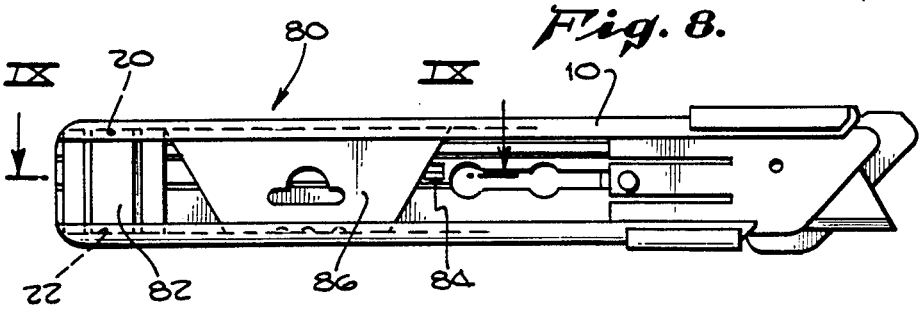
FIG. 8 is a right-hand view of the knife of FIG. 7 in which section IX—IX is taken, and in which a spare-blade retaining means is illustrated.
Figure 9:
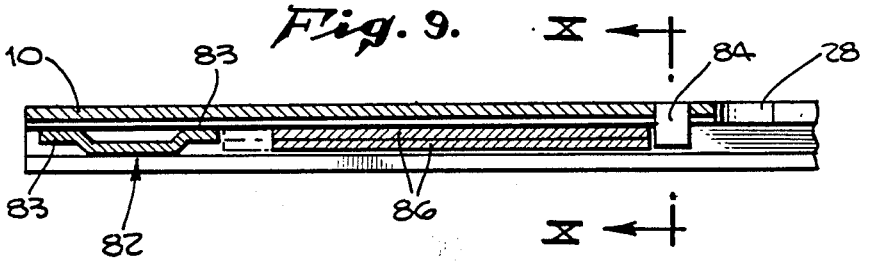
FIG. 9 is an enlarged section through the spare-blade retaining means, as revealed by the section IX—IX taken in FIG. 8.

Such a means for retaining a plurality of replacement blades is indicated generally at 80 in FIG. 8, and comprise a U-shaped retainer clip 82 having top and bottom edges slidably retained in handle top and bottom slots 20 and 22, respectively, a flanged lip 83 at front and rear edges, and a lateral height slightly greater than the width of slots 20 and 22 such that retainer clip 82 is compressed in a lateral direction and retained in place by friction within handle 10 when clip 82 is inserted into the longitudinal recess in handle 10 from the rear end.

Figure 11:
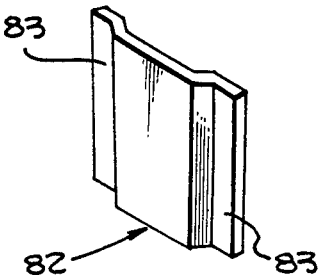
FIG. 11 is a perspective view of a U-shaped retainer clip.
Figure 10:
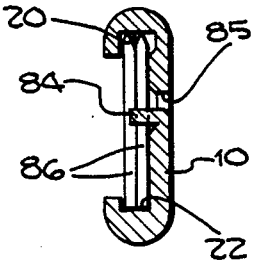
FIG. 10 is a sectional end view through the handle as revealed by the section X—X taken in FIG. 9.

A laterally-extending pin 84 is generated by piercing handle 10 in a C-shaped opening 85 at a position generally central of handle 10 and rearward of a rearward-most of positions of blade-and-keeper-assembly 40 and folding over the tab or pin thus generated to extend laterally for a distance to retain front edges of at least four replacement blades 86 against forward sliding movement within handle 10 (see FIG. 11). Replacement blades 86 are thus retained within handle 10 between pin 84 and retainer clip 82 and are accessed by simply sliding retainer clip 82 rearwardly out of handle 10 to permit removal of a replacement blade 86, followed by a replacement of retainer clip 82 in position, all of which required no special tools or disassembly of knife 1.

Figure 12:
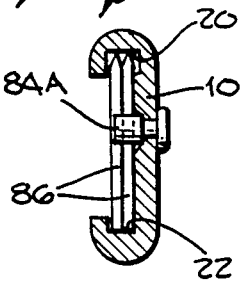
FIG. 12 is a sectional view through the body similar to that revealed by FIG. 10, except illustrating an alternative spare-blade retaining pin.

An alternative configuration of pin 84 is illustrated in FIG. 12, wherein pin 84A comprises a simple rivet.

The materials and construction details of the foregoing discussion should be taken as exemplary in nature, as a wide variety of knives may be achieved by slight variations and/or modifications thereof, depending upon the particular problem at hand. Accordingly, the spirit and scope of the instant invention should be limited only by the claims appended hereto.

I claim:

1. An improved, adjustable-blade safety knife of the type having a one-piece, elongated handle and a keeper plate and cutting blade assembly having top and bottom edges, in which a continuous, longitudinally-extending recess is provided in the handle and coextensive thereof forms a web between thicker edge portions, the recess extending laterally into the edge portions to form opposed, longitudinally-extending top and bottom slots, each slot having a pair of oppositely-faced sidewalls, one of which sidewalls is adjacent and coplaner to the inside wall of the web, between which sidewalls are slidably-retained the top and bottom edges, respectively, of said keeper plate and cutting blade assembly, the blade having a central aperture and being constrianed to slide in side-by-side relationship with the keeper plate within the slots by the engagement of a laterally-extending tang on the top edge of the plate within one of a plurality of notches in the top edge of the blade, the assembly being adjustably-retractable in and out of the forward end of the handle through a plurality of locked positions by movement of a cammed button member acting in cooperation with a spring arm formed integrally of the keeper plate and a notched slot through the web, wherein the improvement comprises:

the provision of at least one indentation in said keeper plate in the side thereof opposite and blade to form a detent on the side thereof adjacent to said blade, said detent being located to protrude laterally through said central aperture of said blade immediately below the upper edge of said aperture such that said blade is supported from below by said detent;

wherein said handle further contains a longitudinally-extending groove in said inside wall of said web, adjacent to said blade, intermediate of said slots and opposed to said detent to clear said laterally-protruding detent;

a hat-shaped retainer clip having a U-shaped body facing the handle web and laterally extending side flanges, top and bottom edges of said clip being slidably-retained in said handle top and bottom slots, respectively, and a height normal to said web slightly greater than the width of said top and bottom slots such that said clip is retained in place in said handle when said clip is inserted into said recess from said handle rear end; and wherein said handle further includes a laterally-extending pin immediately rearward of a rearwardmost of said blade and keeper positions to define a spare-blade retaining space within said handle between said pin and said clip.

2. An improved, adjustable-blade safety knife of the type having a one-piece, elongated handle and a keeper plate and cutting blade assembly having top and bottom edges, in which a continuous, longitudinally-extending recess in the handle forms a web between thicker edge portions, the recess extending laterally into the edge portions to form opposed, longitudinally-extending top and bottom slots, each slot having a pair of oppositely-faced sidewalls, one of which sidewalls is adjacent and coplanar to the inside wall of the web, between which sidewalls are slidably-retained the top and bottom edges, respectively, of the keeper plate and cutting blade assembly, the blade having a central aperture and being constrained to slide in side-by-side relationship with the keeper plate within the slots by the engagement of a laterally-extending tang on the top edge of the plate within one of a plurality of notches in the top edge of the blade, the assembly being adjustably-retractable in and out of the forward end of the handle through a plurality of locked positions by movement of a cammed button member acting in cooperation with a spring arm formed integrally of the keeper plate and a notched slot through the web, wherein the improvement comprises:

the provision of at least one indentation in said keeper plate in the side thereof opposite said blade to form a detent on the side thereof adjacent to said blade, said detent being located to protrude laterally through said central aperture of said blade immediately below the upper edge of said aperture such that said blade is supported from below by said detent;

wherein said handle further contains a longitudinally-extending groove in said inside wall of said web, adjacent to said blade, intermediate of said slots and opposed to said detent to clear said laterally-protruding detent;

a U-shaped retainer clip having top and bottom edges slidably-retained in said handle top and bottom slots, respectively, a flanged lip at front and rear edges, and a lateral height slightly greater than the width of said slots such that said clip is compressed in a lateral direction and retained in place in said handle when said clip is inserted into said recess from said handle rear end; and wherein said handle further includes a laterally-extending pin immediately rearward of a rearwardmost of said blade and keeper positions to define a spare-blade retaining space within said handle between said pin and said clip; and a carton-cutting guide attached to a forward end of said handle, said guide consisting of a thin planar member having a short portion flanged laterally outward from one side of said handle at about a right angle about a first line parallel and coplanar to said forward end of said handle, and a longer portion flanged inwardly at an angle slightly greater than a right angle about a second line substantially parallel to said first line such that a plane of said longer portion is inclined slightly toward the plane of said blade, said longer portion having a length equal to the exposed length of said blade when said blade is extended from said handle and a forward edge parallel to said forward end of said knife, said forward edge being spaced apart from said blade when said blade is extended by at least the thickness of a standard sheet of carton stock.

3. The apparatus of claim 2, wherein:

said forward edge of said guide is spaced apart from said blade by about 3/16".

4. The apparatus of claim 2, wherein:

said handle is first extruded from a hardenable material, then stamped out as a single part.

5. The apparatus of claim 2, further comprising:

at least two tangs formed on said upper edge of said keeper plate for engagement with at least two of said notches in said upper edge of said blade, said tangs extending laterally for at least the width of said blade; and wherein said upper slot sidewall adjacent to said blade contains a longitudinally-extending recess below said one inside wall of said web to clear said laterally-extending tangs.

6. An adjustable-blade safety knife, comprising:

a cutting blade having a central aperture and a plurality of notches in its upper edge;

a keeper plate trifurcated at its rear edge to form a central, rearwardly-extending spring member, said keeper plate having at least two tangs formed on its upper edge to extend laterally for at least the width of said blade and to engage within at least two of said notches in said blade when said blade and said keeper are assembled in a side-by-side assembly, said keeper plate containing at least one indentation therethrough to form a detent on the side of said keeper adjacent to said blade and located to protrude laterally through said central aperture of said blade immediately below the upper edge of said aperture such that said blade is supported from below by said detent;

a one-piece, elongated handle having a continuous, longitudinally-extending recess forming a web between thicker edge portions, said recess extending laterally into said edge portions to form opposed, longitudinally-extending top and bottom slots, each said slot having a pair of oppositely-faced sidewalls, one of said sidewalls being adjacent and coplanar to one wall of said web, said keeper plate and cutting blade assembly being slidably-retained at top and bottom edges thereof between said sidewalls of said top and bottom slots, respectively, to be adjustably-retractable in and out of the forward end of said handle, said handle further containing a longitudinally-extending groove in said one wall of said web, adjacent to said blade, intermediate of said slots and opposed to said detent to clear said laterally-protruding detent, and a longitudinally-extending recess in said upper slot sidewall adjacent to said blade below said one wall of said web to clear said laterally-extending tangs;

positioning means comprising a slot formed through said web of said handle, said slot comprising a continuous slot having a first rectangular portion connected to a second portion comprising a plurality of overlapping and interconnected circular slot portions, and a cammed button member extending laterally of said keeper plate spring arm for fitting said circular slot portions and manually-operable from the side of said handle opposite said slots and connected to said arm for selectably-depressing said arm away from the handle side having said slots out of engagement with said slot portions to adjust the position of said keeper and blade assembly relative to said handle;

a U-shaped retainer clip having top and bottom edges slidably-retained in said handle top and bottom slots, respectively, a flanged lip at front and rear edges, and a lateral height slightly greater than the width of said top and bottom slots such that said clip is compressed in a lateral direction and retained in place in said handle when said clip is inserted into said recess from said handle rear end;

wherein said handle further includes a laterally-extending pin immediately rearward of a rearwardmost of said blade and keeper positions to define a spare-blade retaining space within said handle between said pin and said clip; and a carton-cutting guide attached to said forward end of said handle, said guide consisting of a thin planar member having a short portion flange laterally outward from one side of said handle at about a right angle about a first line parallel and coplanar to said forward end of said handle, and a longer portion flanged inwardly at an angle slightly greater than a right angle about a second line substantially parallel to said first line such that the plane of said longer portion is inclined slightly toward the plane of said blade, said longer portion having a length equal to the exposed length of said blade when said blade is extended from said handle and a forward edge parallel to said forward end of said knife, said forward edge being spaced apart from said blade when said blade is extended by at least the thickness of a standard sheet of carton stock.

7. The apparatus of claim 6, wherein:

said forward edge of said guide is spaced apart from said blade by about 3/16".

8. The apparatus of claim 6, wherein:

said handle is first extruded from a hardenable material, then stamped out as a single part.

9. An adjustable blade safety knife for cutting cartons and the like, comprising:

a cutting blade having a central aperture and a plurality of notches in its upper edge;

a keeper plate trifurcated at its rear end to form a central, rearwardly-extending spring member, said keeper plate having at least two tangs formed on its upper edge to extend laterally for at least the width of said blade and to engage within at least two of said notches in said blade when said blade and said keeper are assembled in a side-by-side assembly, said keeper plate containing at least one indentation therethrough to form a detent on the side of said keeper adjacent to said blade and located to protrude laterally through said central aperture of said blade immediately below the upper edge of said aperture such that said blade is supported from below by said detent;

a one-piece, elongated handle having a continuous, longitudinally-extending recess forming a web between thicker edge portions, said recess extending laterally into said edge portions to form opposed, longitudinally-extending top and bottom slots, each said slot having a pair of oppositely-faced sidewalls, one of said sidewalls being adjacent and coplanar to one wall of said web, said keeper plate and cutting blade assembly being slidably-retained at top and bottom edges thereof between said sidewalls of said top and bottom slots, respectively, to be adjustably-retractable in and out of the forward end of said handle, said handle further containing a longitudinally-extending groove in said one wall of said web adjacent to said blade and intermediate of said slots and opposed to said detent to clear said laterally-protruding detent and a longitudinally-extending recess in said upper slot sidewall adjacent to said blade below said one wall of said web to clear said laterally-extending tangs;

positioning means comprising a slot formed through said web of said handle, said slot comprising a continuous slot having a first rectangular portion connected to a second portion comprising a plurality of overlapping and interconnected circular slot portions, and a cammed button member extending laterally of said keeper plate spring arm for fitting said circular slot portions and manually-operable from the side of said handle opposite said slot portion and connected to said arm for selectively-depressing said arm away from the handle side having said slot portions but of engagement with said slot portions to adjust the position of said keeper and blade assembly relative to said handle;

A U-shaped retainer clip having top and bottom edges slidably-retained in said handle top and bottom slots, respectively, a flanged lip at front and rear edges, and a lateral height slightly greater than the width of said top and bottom slots such that said clip is compressed in a lateral direction and retained in place in said handle when said clip is inserted into said recess from said handle rear end;

wherein said handle further includes a laterally-extending pin immediately rearward of a rearwardmost of said blade and keeper positions to define a spare-blade-retaining space within said handle between said pin and said clip; and a carton-cutting guide attached to said forward end of said handle, said guide consisting of a thin planar member having a short portion flanged laterally outward from one side of said handle at about a right angle about a first line parallel and coplanar to said forward end of said handle, and a longer portion flanged inwardly at an angle slightly greater than a right angle about a second line substantially parallel to said first line such that the plane of said longer portion is inclined slightly toward the plane of said blade, said longer portion having a length equal to the exposed length of said blade when said blade is extended from said handle and a forward edge parallel to a forward end of said knife, said forward edge being spaced apart from said blade when said blade is extended by at least the thickness of a standard sheet of carton stock.

10. The apparatus of claim 9, wherein:

said forward edge of said guide is spaced from said blade by about 3/16".

11. The apparatus of claims 9 or 10, wherein:

said handle is first extruded from a hardenable material, then stamped as a single part.

* * * * *